US009469911B2

(12) United States Patent
McHugh et al.

(10) Patent No.: US 9,469,911 B2
(45) Date of Patent: Oct. 18, 2016

(54) ELECTROPLATING APPARATUS WITH MEMBRANE TUBE SHIELD

(71) Applicant: APPLIED Materials, Inc., Santa Clara, CA (US)

(72) Inventors: Paul R. McHugh, Kalispell, MT (US); Gregory J. Wilson, Kalispell, MT (US); Roey Shaviv, Palo Alto, CA (US)

(73) Assignee: APPLIED Materials, Inc., Santa Clara, CA (US)

( * ) Notice: Subject to any disclaimer, the term of this patent is extended or adjusted under 35 U.S.C. 154(b) by 0 days.

(21) Appl. No.: 14/601,989

(22) Filed: Jan. 21, 2015

(65) Prior Publication Data

US 2016/0208402 A1 Jul. 21, 2016

(51) Int. Cl.
*C25D 5/00* (2006.01)

(52) U.S. Cl.
CPC ..... *C25D 5/00* (2013.01)

(58) Field of Classification Search
CPC ..... C25D 5/00; C25D 7/12
See application file for complete search history.

(56) References Cited

U.S. PATENT DOCUMENTS 7,247,223 B2 7/2007 McHugh et al.
7,332,062 B1 2/2008 Reder et al.
7,727,364 B2 6/2010 Singh et al.
2001/0050233 A1 12/2001 Uzoh et al.
2002/0046952 A1* 4/2002 Graham ..... C25D 7/12 205/99
2003/0079995 A1 5/2003 Contolini et al.
2004/0055873 A1 3/2004 Greenspan
2005/0109628 A1 5/2005 Wilson et al.
2006/0243598 A1* 11/2006 Singh ..... C25D 5/04 205/260
2010/0032303 A1 2/2010 Reid et al.
2010/0044236 A1* 2/2010 Mayer ..... C23C 18/1601 205/80
2013/0137242 A1 5/2013 He et al.
2013/0146447 A1 6/2013 Wilson et al.
2014/0326608 A1* 11/2014 He ..... C25D 17/008 205/143

OTHER PUBLICATIONS

Korean Intellectual Property Office, International Application Division, "The International Search Report and The Written Opinion of the International Searching Authority" issued in International Application No. PCT/US2016/013930 (Jul. 1, 2016).

* cited by examiner

*Primary Examiner* — Ciel Thomas
(74) *Attorney, Agent, or Firm* — Kenneth H. Ohriner; Perkins Coie LLP

(57) ABSTRACT

An electroplating apparatus has one or more membrane tube rings which act as electric field shields, to provide advantageous plating characteristics at the perimeter of a work piece. The membrane tube rings may be filled with fluids having different conductivity, to change the shielding effect as desired for electroplating different types of substrates. The membrane tube rings may optionally be provided in or on a diffuser plate in the vessel of the apparatus.

10 Claims, 2 Drawing Sheets

ELECTROPLATING APPARATUS WITH MEMBRANE TUBE SHIELD

BACKGROUND OF THE INVENTION

Manufacture of microelectronic devices and other micro-scale devices typically requires formation of multiple metal layers on a wafer or other substrate. By electroplating metals layers in combination with other steps, patterned metal layers forming the micro-scale devices are created.

The substrate is electroplated in a plating apparatus or chamber, with one side of the substrate in a bath of liquid electrolyte, and with electrical contacts touching a conductive layer on the substrate surface. Electrical current is passed through the electrolyte and the conductive layer. Metal ions in the electrolyte plate out onto the substrate, forming a metal film on the substrate. To better achieve uniform plated film thickness, the plating apparatus may have an annular dielectric shield, which shields or reduces the electric field in the electrolyte near the edge of the substrate.

Achieving a uniformly thick plated metal film can be difficult, for various reasons. In Damascene plating, the sheet resistance of the film changes during the plating process, which alters the electric field within the plating apparatus and tends to cause the plated film at the wafer edge to be thicker. In wafer level packaging applications, the active plating area around the edge of the wafer can vary significantly, depending on the patterns on the wafer. The active plating area may also vary depending on the specified edge exclusion zone or dimension. Substrate diameters may also vary by up to several millimeters. This can cause variations in the plated metal film near the perimeter of the substrate, due to the varying geometries resulting from changing substrate diameters.

In present electroplating apparatus, to achieve optimum plating results, the electric field shields must be changed to match the characteristics of the wafer. As changing the shields is time consuming, there is a need for plating apparatus that can adjust for a changing wafer active area without having to change the shields.

SUMMARY OF THE INVENTION

An electroplating apparatus has one or more membrane tube rings which act as electric field shields, to provide advantageous plating characteristics at the perimeter of a substrate. The membrane tube rings may be filled with fluids having different conductivity, to change the shielding effect as desired for electroplating different types of substrates. The membrane tube rings may optionally be provided in or on a diffuser plate in the vessel of the apparatus.

DETAILED DESCRIPTION

Figure 1:
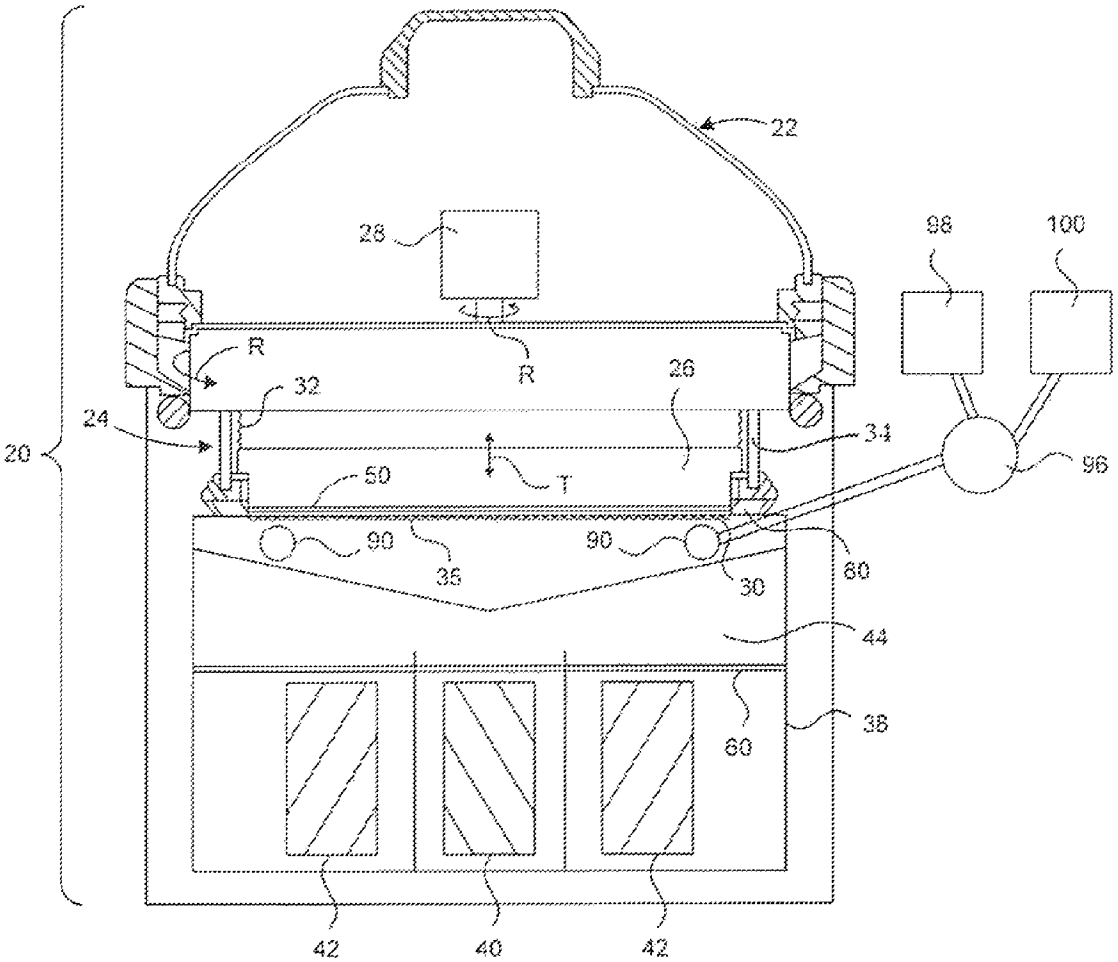
FIG. 1 is a schematic section view of an electroplating apparatus.

In FIG. 1, an electroplating apparatus 20 has a rotor 24 in a head 22. The rotor 24 includes a backing plate 26 and a contact ring 30 having a seal ring 80. Contact ring actuators 34 move the contact ring 30 vertically (in the direction T in FIG. 1), to engage the contact ring 30 and the seal ring 80 onto the down facing surface of a wafer or substrate 50. A bellows 32 may be used to seal internal components of the head.

The contact ring typically has metal fingers 35 that contact a conductive layer on the substrate 50. In FIG. 1, the head 22 is shown positioned to place the substrate 50 in a process position, where the substrate is in contact with the bath of liquid electrolyte held in a vessel 38. For processing a 300 mm diameter substrate, the vessel may have a diameter of 305 to 380 mm.

FIG. 1 shows a design having a center electrode 40 surrounded by a single outer electrode 42, although multiple concentric outer electrodes may be used. A single electrode may also be used. In a typical electroplating process, for example with copper Damascene, the electrodes 40 and 42 are anodes, and the substrate is connected to a cathode. An electric field shaping unit 44 made of a di-electric material may be positioned in the vessel between the electrodes and the wafer. A membrane 60 may optionally be included, with anolyte in a lower chamber below the membrane and with catholyte in an upper chamber above the membrane 60. If no membrane 60 is used, the vessel forms a single chamber holding a single electrolyte. Electric current passes from the electrodes through the electrolyte to a conductive surface on the wafer. A motor 28 in the head may be used to rotate the wafer during electroplating.

A membrane tube 90 formed into a ring is provided in the vessel. The membrane tube 90 is positioned so that is adjacent to the outer edge of substrate 50, and between the substrate 50 and the anodes 40 and/or 42. Generally the membrane tube 90 may be within 1-3 mm of the substrate, to better control the electric field near the edge of the substrate 50. The membrane tube 90 may be attached to and supported on the side wall of the vessel 38, or on the field shaping unit 44. Depending on the specific vessel used, the membrane tube 90 may be supported on dielectric standoffs or brackets.

The membrane tube 90 has an inlet and an outlet to allow the membrane tube 90 to be filled with a fluid having an electrical conductance suitable for providing the shielding desired. For example, the inlet may be plumbed to a valve 96 connected to fluid sources 98 and 100, such as air, nitrogen or other gas, and/or a source of an electrolyte or water. The outlet may be plumbed to a drain for use in purging the membrane tube 90, or to a recirculation line. In use, the fluid in the membrane tube 90 may be flowing or static.

The membrane tube may be a membrane material, such as Nafion sulfonated tetrafluoroethylene based fluoropolymer-copolymer. A Nafion tube has a conductance (e.g. typically about 20-100 mS/cm) sufficient to cause the membrane tube itself to act as a partial shield. Other membrane tube materials having greater conductivity may be used to reduce the minimum shielding effect provided. A typical membrane tube 90 may have an outer diameter of 2-6 mm, a wall thickness of about 0.5 mm, and an inner diameter of 2.5 to 6 mm, or 3 to 5 mm. Alternatively, a round, square or rectangular duct may be built into the cylindrical sidewall of the vessel to achieve the same effect.

Figure 2:
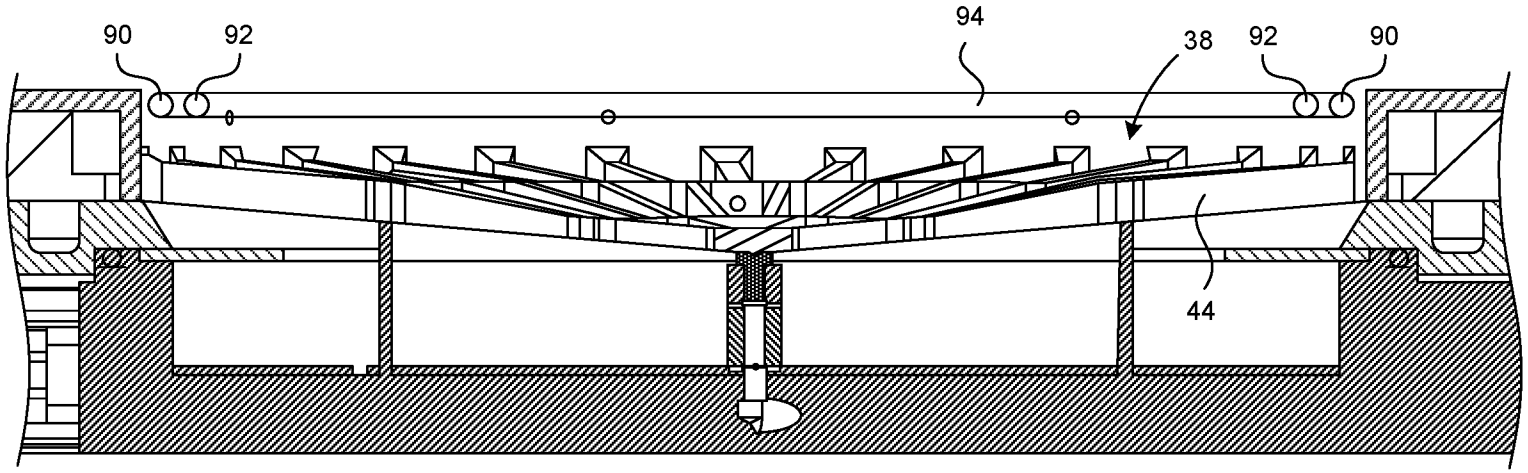
FIG. 2 is a schematic section view of a vessel of an alternative electroplating apparatus.

As shown in FIG. 2, membrane tubes 90 and 92 may be arranged on or within a diffuser plate 94 to compensate for a particular wafer pattern or a wafer scribe mark. The membrane tubes 90 and 92 are formed into rings, and are referred to here as ring membrane tubes. Using the ring membrane tubes with a diffuser plate allows a single electroplating apparatus 20 to more uniformly plate substrates having different sizes. The inner membrane tube 92 and an the outer membrane tube 90 may be plumbed together, so that both membrane tubes are supplied with the same fluid. Each membrane tube 90 and 92 may be formed into a ring or circle and secured in position in or on the vessel 38.

If the two membrane tubes 90 and 92 have the same fluid, they may be provided as a single tube formed into two rings, with a transition region where the tube moves from the inner ring to the outer ring. If the two tubes are separate, they may be supplied with different fluids from separate plumbing connections outside the chamber. This allows for added control of the shielding, i.e., the effective shield ID may vary based upon whether only the inner tube or both tubes were filled with a non-conducting fluid.

Membrane tubes may be distributed across the entire face of a diffuser plate to achieve radial current density control (i.e. to replicate the functionality of concentric anodes). To make the shield inactive, membrane tubes may be imbedded within a 20% open area diffuser. The open area provides the diffuser with a resistance matched to the resistance of a 20 mS/cm Nafion membrane tube when filled with catholyte. In applications where the substrate does not rotate during processing, a diffuser plate specifically designed to work with a specific substrate pattern may be used. In this case, the membrane tubes are laid out within the diffuser plate in a way that compensates for electric field variations caused by a particular wafer pattern or a scribe area. Membrane tubes may alternatively be distributed across the whole diffuser plate to achieve radial current density control. Two or more rings of membrane tubes may be used in a diffuser plate, as shown in FIG. 2, or without a diffuser plate, as shown in FIG. 1.

The dielectric material annular shield in a conventional plating apparatus may be replaced with a membrane tube 90 to create an adjustable chamber shield. With the membrane tube filled with catholyte (or a higher conductivity fluid), it is inactive as a shield, because it is immersed in or surrounded by the catholyte, or electrolyte, in the vessel 38 having the same conductivity. However, when filled with a gas, such as air or nitrogen, or a liquid such as deionized water, having a conductivity lower than the surrounding electrolyte, the membrane tube acts as shield to the electric field. One or more membrane tubes 90 may also be used in an electroplating apparatus set up as a bridge apparatus capable of processing different size wafers, with the membrane tube 90 altering the electric field in the vessel as needed for a selected wafer size. A wire electrode may be positioned within a membrane tube to better allow the membrane tube itself to act as an anode or a current thief.

Liquids of varying conductivity may be used in the membrane tube 90 to achieve shielding matched to a specific substrate. Changing the conductivity of the fluid in the membrane tube may also be used to compensate for changing process conditions, such as the changing film resistance that may occur during plating. A higher conductivity fluid in the membrane tube may be used to increase current flow locally (as opposed to local shielding).

As used here membrane tube or membrane tube ring means a tube of a material that allows ionic current to flow through the tube walls. One or both of the membrane tubes 90 and 92 may optionally be connected to an anode current source and operated as anodes, with or without simultaneous operation of the anodes 40 and/or 42. In this use, an inert or an active anode conductor may be provided in the membrane tubes. It is also possible for the anode of the membrane tubes to be formed via a material different from the material of the vessel anodes 40 and 42 to allow multiple materials to be co-plated, for example as with plating solder. The conductor providing the anode current in the membrane tube may be a wire, with the wire pulled through the membrane tube to replenish the anode material, as needed.

Thus, novel apparatus and methods have been shown and described. Various changes and substitutions may of course be made without departing from the spirit and scope of the invention. The invention, therefore, should not be limited except by the following claims and their equivalents.

The invention claimed is:

1. Apparatus comprising:

a vessel for holding a first electrolyte;

one or more anodes in the vessel;

a substrate holder for holding a substrate in a process position in the vessel;

a membrane tube ring in the vessel vertically between the one or more anodes and the process position; and the membrane tube ring having no electrode therein and containing a gas or a liquid having an electrical conductivity less than the first electrolyte;

wherein the membrane tube ring shields the substrate holder from an electric field in the first electrolyte created by the one or more anodes.

2. The apparatus of claim 1 comprising at least one fluid source and a valve for connecting the at least one fluid source to the membrane tube ring.

3. The apparatus of claim 1 further comprising a second membrane tube ring in the vessel concentric with and adjacent to the membrane tube ring.

4. The apparatus of claim 3 with the second membrane tube ring adjoining the membrane tube ring.

5. The apparatus of claim 1 further including a diffuser plate in the vessel, with the membrane tube ring in or on the diffuser plate.

6. The apparatus of claim 1 with the vessel having a diameter of 305 to 380 mm and with the membrane tube ring having an outside diameter of 2-6 mm.

7. The apparatus of claim 1 further including a dielectric field shaping unit in the vessel between the one or more anodes and the process position, and with the membrane tube ring vertically between the field shaping unit and the substrate.

8. The apparatus of claim 1 with the substrate holder further including a rotor for rotating the substrate.

9. Apparatus comprising:

a vessel;

a first electrolyte and at least one anode in the vessel providing an electric field in the first electrolyte;

a substrate holder including a rotor for holding a substrate in a process position in the vessel;

a membrane tube ring in the vessel above the at least one anode and below the process position;

the membrane tube ring having no electrode therein and containing a second electrolyte having an electrical conductivity less than the first electrolyte; and a dielectric field shaping unit in the vessel below the membrane tube ring and between the at least one anode and the process position with the difference in conductivity between the first electrolyte and the second electrolyte causing the membrane tube ring to reduce the electric field at a perimeter of the process position.

10. Apparatus comprising:

a vessel holding an electrolyte;

one or more anodes in the vessel;

a substrate holder for holding a substrate in a process position above the anodes;

a membrane tube ring in the vessel between the one or more anodes and the process position, a first fluid source containing a first fluid and a second fluid source containing a second fluid, with the first fluid having an electrical conductivity different from the second fluid and from the electrolyte;

a valve for connecting the first fluid source or the second fluid source to the membrane tube ring;

wherein the membrane tube ring has no electrode therein and shields the substrate holder from an electric field in the first electrolyte created by the one or more anodes when the membrane tube ring is supplied with the first fluid from the first fluid source.

* * * * *